US006875073B1

(12) United States Patent
Petersen et al.

(10) Patent No.: US 6,875,073 B1
(45) Date of Patent: Apr. 5, 2005

(54) WATER SINKER TOY

(76) Inventors: Scott T. Petersen, 10435 Los Alamitos Blvd., Los Alamitos, CA (US) 90720; James E. Kelley, 2355 Rim Rd., Duarte, CA (US) 91010

( * ) Notice: Subject to any disclaimer, the term of this patent is extended or adjusted under 35 U.S.C. 154(b) by 13 days.

(21) Appl. No.: 10/603,432

(22) Filed: Jun. 25, 2003

Related U.S. Application Data

(60) Provisional application No. 60/391,733, filed on Jun. 25, 2002.

(51) Int. Cl.[7] ..... A63H 23/00
(52) U.S. Cl. ..... 446/153
(58) Field of Search ..... 446/153, 73, 219, 446/154, 155, 156, 158, 159; 43/42.38, 42.39

(56) References Cited

U.S. PATENT DOCUMENTS

| | | | | |
|---|---|---|---|---|
| 3,332,166 | A | 7/1967 | Alexander | |
| 3,499,647 | A | 3/1970 | Nestler | |
| 3,682,753 | A | 8/1972 | Willinger | |
| 3,897,647 | A * | 8/1975 | Black | 43/42.38 |
| D258,902 | S | 4/1981 | Strickland | |
| 4,516,350 | A * | 5/1985 | Malphrus | 43/17.6 |
| 4,563,161 | A | 1/1986 | Zimmerman | |
| 4,588,618 | A | 5/1986 | Wolfe | |
| 4,744,167 | A * | 5/1988 | Steele | 43/42.06 |
| 5,096,453 | A * | 3/1992 | Van Meter | 446/73 |
| 5,299,378 | A * | 4/1994 | Ballard | 43/42.06 |
| D351,047 | S | 9/1994 | Hendren | |
| 5,495,690 | A * | 3/1996 | Hunt | 43/17.6 |
| 5,517,782 | A * | 5/1996 | Link et al. | 43/42.31 |
| 5,722,871 | A | 3/1998 | Zamir | |
| 5,778,593 | A | 7/1998 | Baron | |
| 5,810,364 | A | 9/1998 | Canion | |
| 5,813,931 | A | 9/1998 | Gormley | |
| 5,865,662 | A | 2/1999 | Dammann | |
| 6,212,818 | B1 * | 4/2001 | Huddleston | 43/42.37 |
| 6,393,757 | B2 * | 5/2002 | Bomann | 43/42.09 |
| 6,598,336 | B2 * | 7/2003 | Link | 43/42.28 |
| 6,641,787 | B1 * | 11/2003 | Siggins et al. | 422/264 |
| 2003/0084602 | A1 * | 5/2003 | Reed | |

FOREIGN PATENT DOCUMENTS

| | | | |
|---|---|---|---|
| JP | 404361779 A | * | 12/1992 |
| WO | WO 02/45501 A1 | * | 6/2002 |

* cited by examiner

*Primary Examiner*—Jacob K. Ackun
*Assistant Examiner*—Faye Francis
(74) *Attorney, Agent, or Firm*—James G. O'Neill, Klein, O'Neill & Singh, LLP

(57) ABSTRACT

A water sink toy is sized and dimensioned to move and sink in water so as to simulate a squid, or the like. The sink toy includes a shaped, weighted head having an opening formed therein. A number of tentacle-like, floatable elongated members are secured to the head so as to move in water and provide buoyancy to the sink toy. The opening in the head may be used to grasp the head, to enable it to be worn on a finger in the manner of a ring, or to be attached to other objects.

20 Claims, 4 Drawing Sheets

WATER SINKER TOY

This application claims the benefit of pending provisional application No. 60/391,733, filed on Jun. 25, 2002.

BACKGROUND OF THE INVENTION

1. Field of the Invention

This invention relates generally to toys, and more particularly, to a pool toy that moves and sinks in water, and has animal or plant-like characteristics.

2. Description of Related Art

It is well known to provide various amusement devices for use in water. In particular, there are a number of devices or toys for use by children playing in bathtubs and pools. These known devices or toys provide endless hours of enjoyment and entertainment for children.

However, the known bath or pool devices or toys are limited to specifically shaped or acting fixed or variable buoyancy devices, or toys. Many of these devices rest or are secured at the bottom of a pool for retrieval by a diving child. Additionally, there are a number of other devices or toys that are formed in the shape of animals, fish or persons for use in air or in water. All of the known devices or toys are acceptable for their intended purposed, but are limited and not entirely satisfactory or versatile enough to be used in all types of games or play.

Therefore, there exists the need for a pool sink toy that moves and provides more satisfactory play value.

SUMMARY OF THE INVENTION

Accordingly, it is a general object of the present invention to provide an improved and simplified water toy. It is a particular object of the present invention to provide an improved and simplified pool sink toy. It is yet another particular object of the present invention to provide an improved and simplified pool sink toy that moves in an unpredictable manner while sinking. It is yet another particular object of the present invention to provide an improved and simplified underwater toy having a weighted head with an opening formed therein, secured to a plurality of elongated members that float in the water. And it is yet a still further object of the present invention to provide an underwater sink toy having an opening formed in a head to allow the toy to be easily grasped, worn as a ring on a finger, or collected together with other toys.

These and other objects and advantages of the present invention are achieved by providing a device having a base with an opening formed therein. The base is made from a material that will sink in water. A plurality of elongated members, made from a material that floats in water, are secured to the base to enable the device to sink in water with the base floating downwardly, and which device will move in reaction to currents in the water. The opening formed in the base allows the device to be easily collected together with other devices, or grasped or worn by a user during play.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein:

DESCRIPTION OF THE PREFERRED EMBODIMENTS

Figure 1:
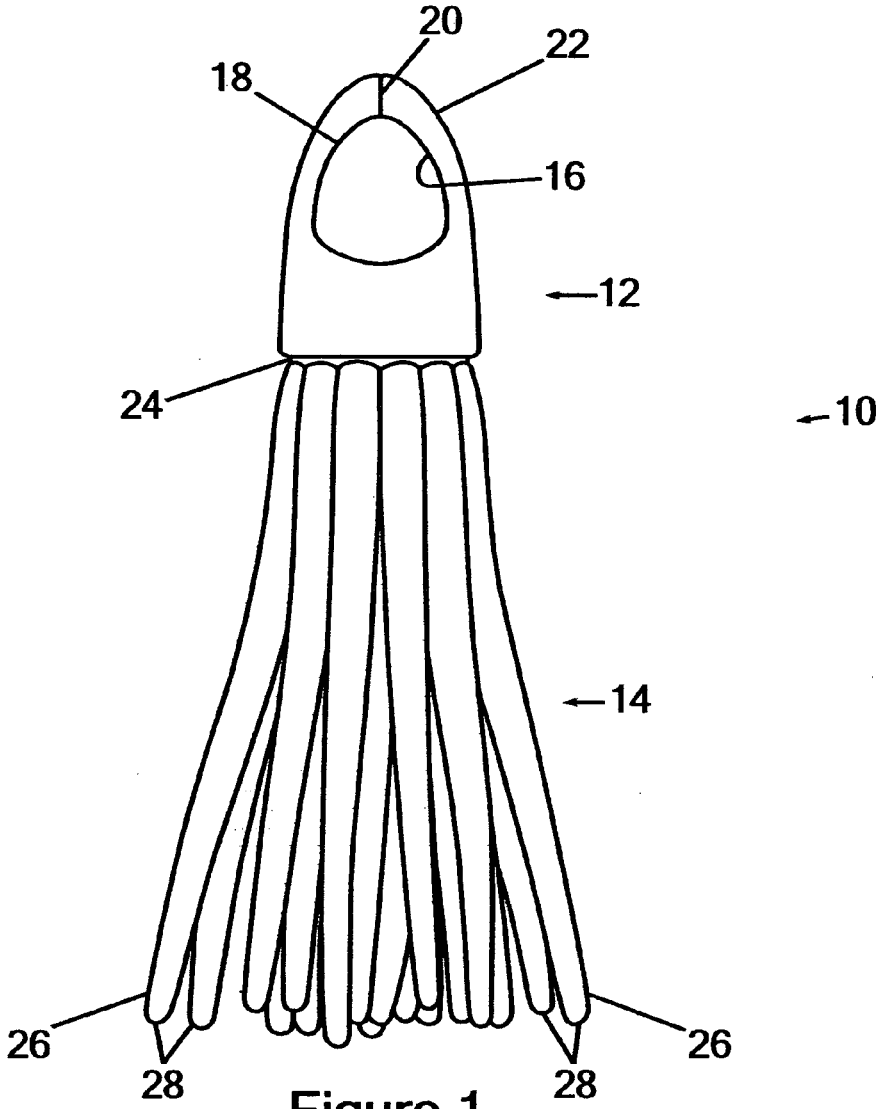
FIG. 1 is a front elevational view of a sinker toy of the present invention.
Figure 2:
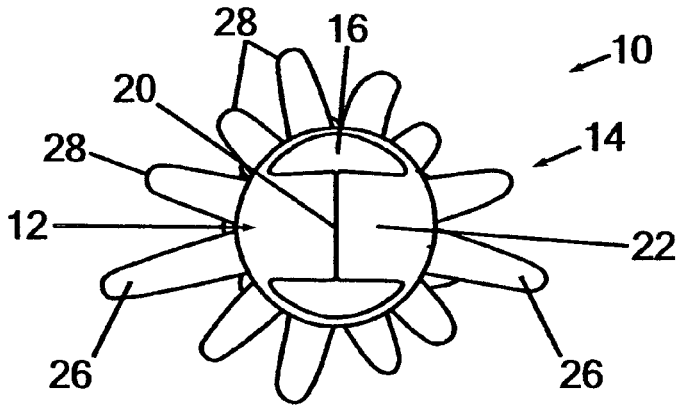
FIG. 2 is a top plan view of the sinker toy of FIG. 1.
Figure 3:
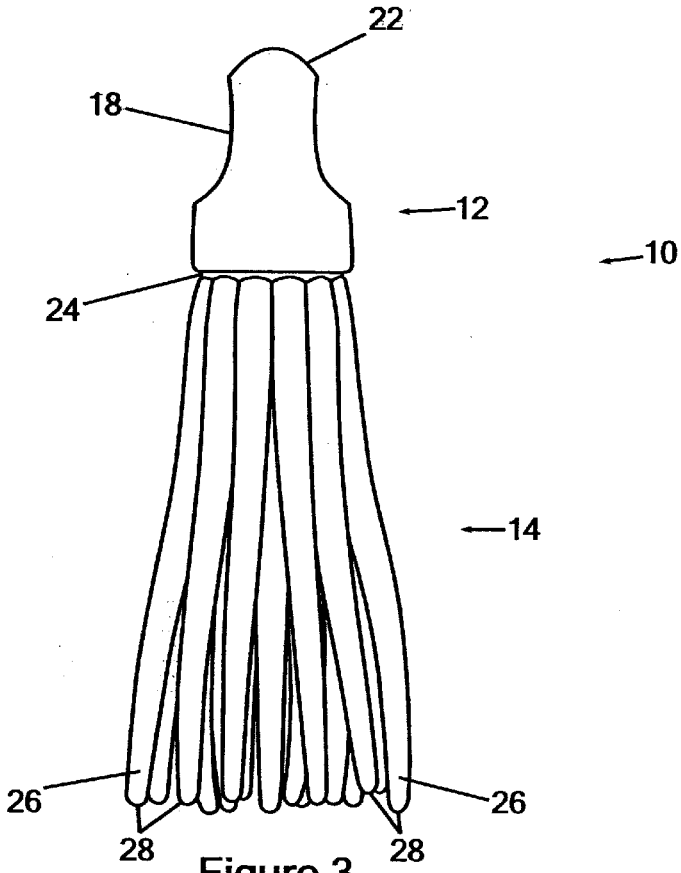
FIG. 3 is a side elevational view of the sinker toy of FIG. 1.
Figure 4:
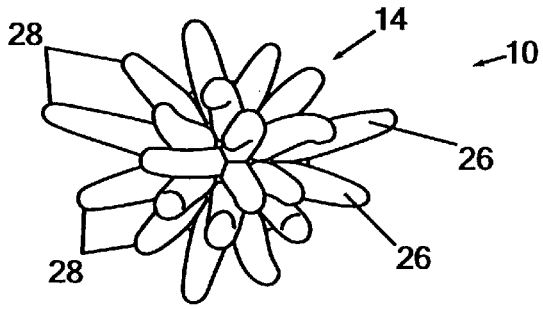
FIG. 4 is a bottom plan view of the sinker toy of FIG. 1.
Figure 5:
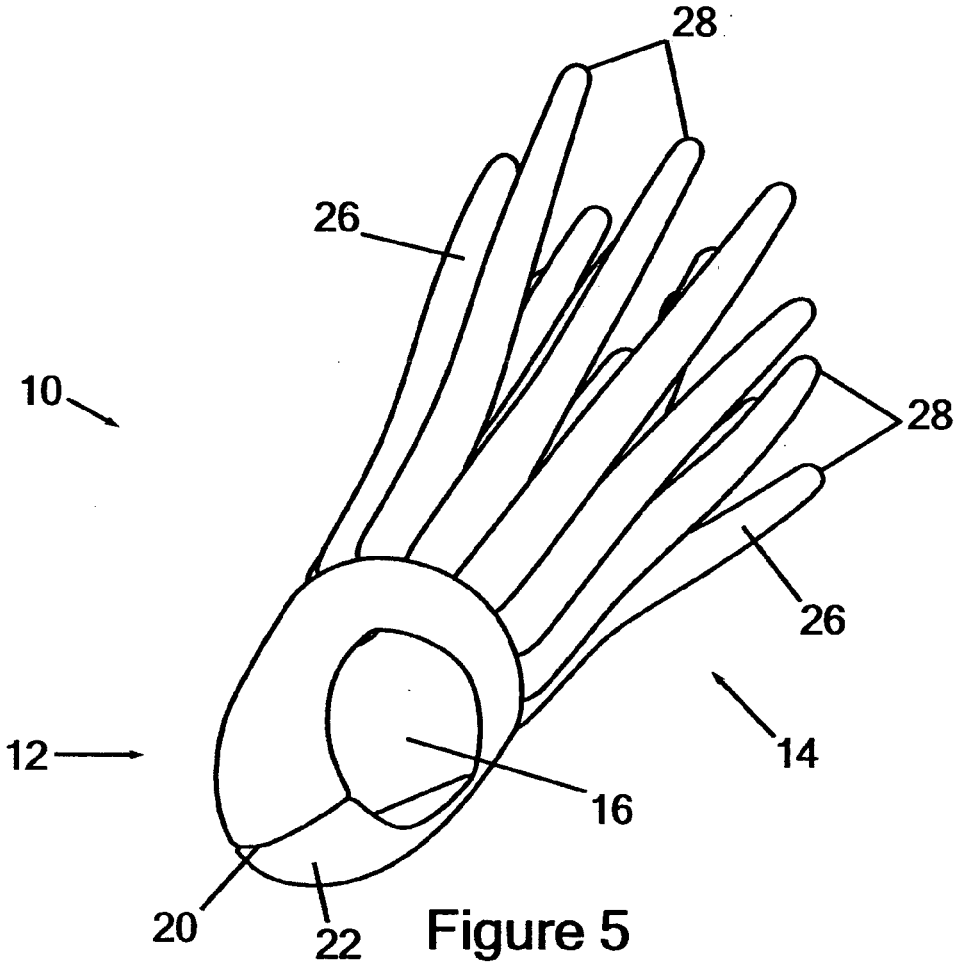
FIG. 5 is a perspective view of the sinker toy, looking toward the base.
Figure 6:
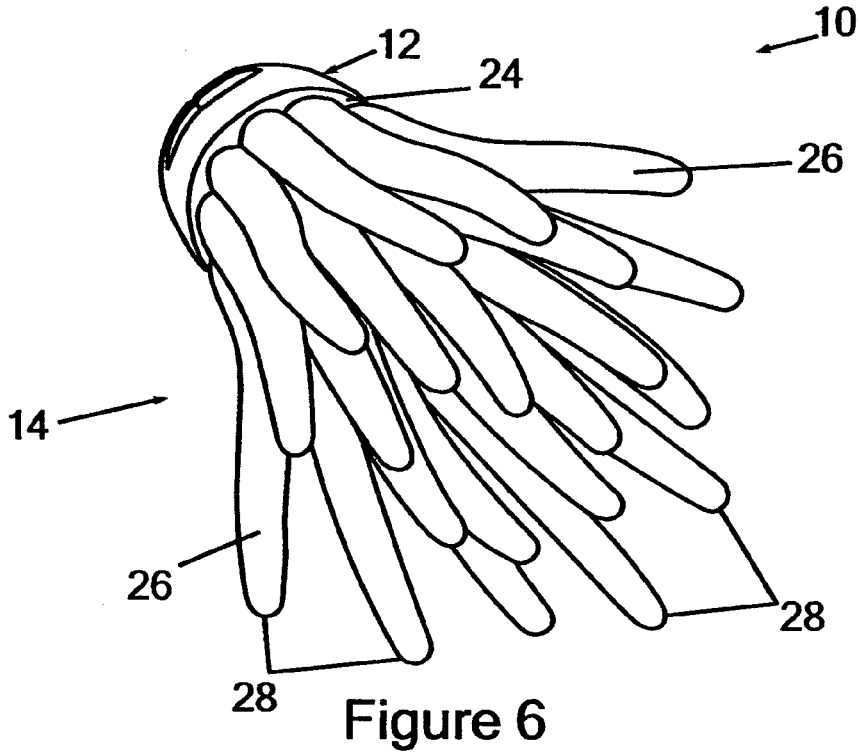
FIG. 6 is a further perspective view of the sinker toy, looking toward the tail and the elongated members.
Figure 7:
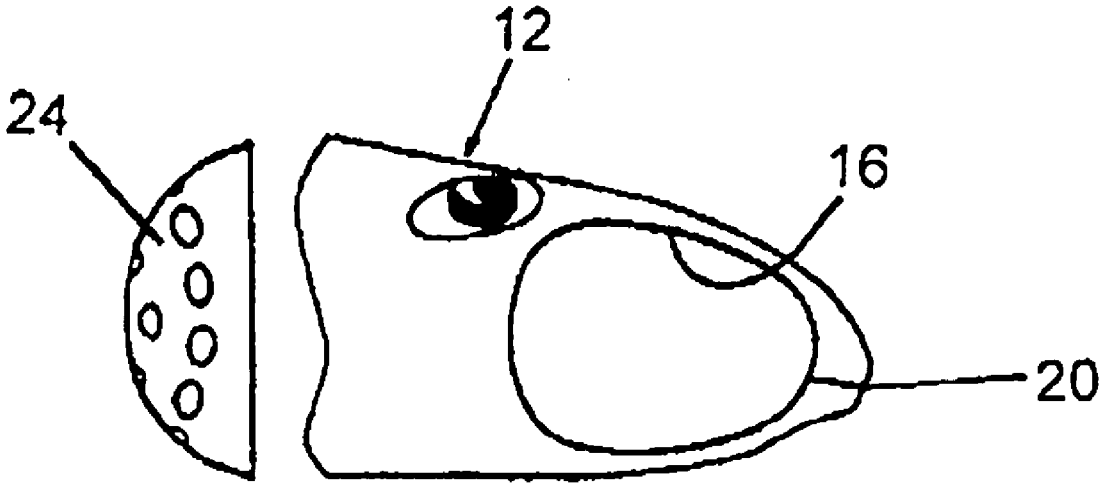
FIG. 7 is a further exploded perspective view showing a second embodiment of the head with an inner end that is uneven or wavy and apertures or openings to hold elongated members.

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to provide for an improved and simplified water sinker device or toy 10 that is sized and dimensioned to slowly move and sink in water to simulate a squid, or the like.

The toy 10 is comprised of a base or head 12 and a tail portion 14. The base or head 12 may be of any desired size and shape, and is preferably made from a hard rubber, light metal or plastic, of sufficient weight to enable the entire toy to sink in water, while the tail portion is made from a floatable material to provide the device with buoyancy.

The base or head 12 may also include a hole or opening 16 formed therein to create a ring 18 that can be opened for adjustment, along line or space 20. The head 12 and opening 16 could be circular, flat, oblong, rectangular, etc. However, in a currently preferred embodiment the head 12 and opening 16 are preferably approximately oval in shape. The base or head 12 is preferably shaped, sized and dimensioned so as to smoothly move or sink through water and may include fins. The head 12 is illustrated as having a substantially half oval, ballistic-shaped outer end 22 which would floating downwardly. This outer end could, of course be flattened or have a platform added thereto. The head 12 has a larger inner end 24. In one preferred embodiment of the invention, the head 12 is made from a hardened rubber material approximately 1½" to 2" long. The inner end 24 of the head is substantially circular, and may be substantially flat, but preferably has an uneven or wavy surface with a diameter of approximately 1". The head 12 may be provided with eyes and/or facial features, and may be of any color or desired design and/or shape, with or without fins.

The tail portion 14 includes a plurality of elongated members 26 removably secured to the flattened, larger inner end 24 of head 12. These members 26 may be removably inserted in apertures or openings formed in the inner end 24 for easy replacement. The elongated members 26 are preferably made from a soft, lightweight material, such as silicone, rubber, or an equivalent soft plastic that floats in water. The number of elongated members 26 used in the tail portion 14 may vary, depending on the size and weight of the head 12, the length of each elongated member and the desired rate of movement and/or sinking of the toy 10 in a pool, or the like. The number of elongated members may vary between about 6 to 52, with a preferred range of from about 12 to 25. The number of elongated members 26 is selected to closely match the weight of the head so as to allow the toy 10 to slowly move and sink in water. The outer end 22 of the head 12 will be pointing generally downwardly toward the bottom of a pool, or the like, and the elongated members 26 will slowly move in water to simulate the tentacles of a squid, or the like. The elongated members 26 may take any desired shape, but are preferably substantially circular or oval in diameter with rounded outer ends. The actual tentacles used on the toy may be of different shapes, or all the same shape. For example, 50% of the tentacles on the toy 10 may be one shape while the other 50% of the tentacles may be another shape.

In a currently preferred embodiment of the invention, the tail 14 comprises a set of about 16 elongated members, 8 of which are substantially circular and 8 of which are oval shaped tentacles. Each of the tentacles is about 4¼" about 4⅝" in length and tapers from approximately ¼" where they are connected to or in the inner end 24 of head 12, to a rounded outer end or tip 28, about ⅛" in diameter.

The unique design of the sink toy 10 of the present invention captures or mimics the look of a squid-like underwater creature as it moves or sinks in water. The weighted ring head 12 having the opening 16 therein provides an easy way for a person to grasp or hold onto the toy 10. Additionally, the opening 16 allows the sink toy 10 to be worn like a ring on a finger of a user, or may be used to attach the toy to various objects.

For example, when used during swimming in water, for example in a swimming pool, a person can place the sink toy 10 on one of their fingers and will be able to paddle or swim substantially unencumbered. Also, during play in water, such as in a swimming pool, a swimmer can "spear" the sink toy 10 on a finger to "thread the needle" and capture the sink toy.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A water sinker toy comprised of:

a head made from a material having sufficient weight to enable the water sinker toy to sink in water;

a tail portion having a plurality of tapered elements made from floatable material to provide the water sinker toy with buoyancy;

the head having an opening extending therethrough and including a space to allow the opening to be adjustable in size; and the plurality of tapered elements being removably secured in the head and being formed as elongated members that will move when in water to simulate tentacles of a squid.

2. The water sinker toy of claim 1 wherein the head and the opening are approximately oval in shape with the head having a shaped outer end, away from the tail portion.

3. The water sinker toy of claim 2 wherein the head has an inner end that is larger than the shaped outer end with the plurality of elongated members removably secured to the larger inner end.

4. The water sinker toy of claim 3 wherein the plurality of elongated members are removably secured in apertures formed in the larger inner end.

5. The water sinker toy of claim 4 wherein the shaped outer end of the head includes the space formed therein.

6. The water sinker toy of claim 5 wherein the head is made from hard rubber, light metal or plastic and the elongated members are made from silicone or rubber.

7. The water sinker toy of claim 6 wherein there are between 6 to 52 elongated members.

8. The water sinker toy of claim 7 wherein the elongated members are varied in shape with some of the elongated members being substantially circular in shape and others being oval shaped; the elongated members being between about 4¼" and 4⅝" in length; and tapering from approximately ¼" in diameter where they are connected in the larger inner end of the head, to rounded outer tips of about ⅛" in diameter.

9. The water sinker toy of claim 6 wherein there are between 12 to 25 elongated members.

10. The water sinker toy of claim 9 wherein the elongated members are varied in shape with some of the elongated members being substantially circular in shape and others being oval shaped; the elongated members being between about 4¼" and 4⅝" in length; and tapering from approximately ¼" in diameter where they are connected in the larger inner end of the head, to rounded outer tips of about ⅛" in diameter.

11. The water sinker toy of claim 1 wherein the outer end of the head includes the space therein.

12. The water sinker toy of claim 11 wherein the head and the opening are approximately oval in shape with the head having an outer end, away from the tail portion, that has a substantially half oval, ballistic-shaped, and wherein the head has an inner end that is larger than the outer end, with the plurality of elongated members removably secured in apertures formed in the larger inner end.

13. The water sinker toy of claim 12 wherein the head is made from hard rubber, light metal or plastic and the elongated members are made from silicone, or rubber; and wherein there are between 12 to 52 elongated members.

14. The water sinker toy of claim 13 wherein the elongated members are substantially oval shaped, about 4⅝" in length and taper from approximately ¼" in diameter where they are connected in the flat larger inner end of the head, to rounded outer tips of about ⅛" in diameter.

15. A water sinker toy comprised of:

a substantially oval head having an outer end with a substantially half oval, ballistic-shape and an inner end that is larder than the outer end; the substantially oval head being made from a material having sufficient weight to enable the water sinker toy to sink in water;

a tail portion having a plurality of elements in the shape of tentacles, made from floatable material to provide the water sinker toy with buoyancy;

the substantially oval head having a substantially oval opening formed therein and the outer end having a space that can be opened for adjustment of the size of the opening; and the plurality of elements being removably secured in apertures formed in the larger inner end of the head so that will move when in water to simulate tentacles of a squid.

16. The water sinker toy of claim 15 wherein the substantially oval head is made from hard rubber, light metal or plastic and the elongated members are made from silicone or rubber.

17. The water sinker toy of claim 16 wherein there are between 12 to 52 elongated members.

18. The water sinker toy of claim 17 wherein the elongated members are substantially oval in shape and about 4⅝" in length; the elongated members tapering from approximately ¼" in diameter where they are connected in the, larger inner end of the head, to rounded outer tips of about ⅛" in diameter.

19. The water sinker toy of claim 16 wherein there are between 16 to 25 elongated members.

20. The water sinker toy of claim 19 wherein the elongated members are substantially oval in shape and about 4⅝" in length; the elongated members tapering from approximately ¼" in diameter where they are connected in the flattened, larger inner end of the head, to rounded outer tips of about ⅛" in diameter.

* * * * *